United States Patent [19]

Groth et al.

[11] Patent Number: 4,827,729

[45] Date of Patent: May 9, 1989

[54] METHOD OF REMOVING A MIST COATING FROM THE INTERIOR FACE OF A GLAZED PANEL OF A REFRIGERATING CABINET

[75] Inventors: Rolf Groth, Bochum; Hans Bause, Witten, both of Fed. Rep. of Germany

[73] Assignee: Flachglas AG, Furth, Fed. Rep. of Germany

[21] Appl. No.: 216,591

[22] Filed: Jul. 7, 1988

[30] Foreign Application Priority Data

Jul. 7, 1987 [DE] Fed. Rep. of Germany ..... 3722349

[51] Int. Cl.[4] ..... F25D 21/04

[52] U.S. Cl. ..... 62/80; 62/248

[58] Field of Search ..... 62/248, 80, 150, 186; 52/171

[56] References Cited

U.S. PATENT DOCUMENTS

| | | | |
|---|---|---|---|
| 3,307,373 | 3/1967 | Booth | 62/248 |
| 4,009,586 | 3/1977 | Skvarenina | 62/80 |
| 4,528,820 | 7/1985 | Jonasson | 62/80 |
| 4,750,335 | 6/1988 | Wallace et al. | 62/248 |

FOREIGN PATENT DOCUMENTS 3722349 4/1988 Fed. Rep. of Germany .

*Primary Examiner*—William E. Tapolcai

*Attorney, Agent, or Firm*—Herbert Dubno

[57] ABSTRACT

There is disclosed a method for the removal of a coating of mist at the interior face of a glazing panel, especially of high thermally insulating glass, of a refrigerating cabinet, operating with forced air circulation, after the opening and closing of a door of the cabinet. In order to remove the coating, the speed of circulation of the air after closing of the door is temporarily increased until decomposition of the coating has taken place and thereafter is reduced back to the level required for normal cooling operation.

8 Claims, 1 Drawing Sheet

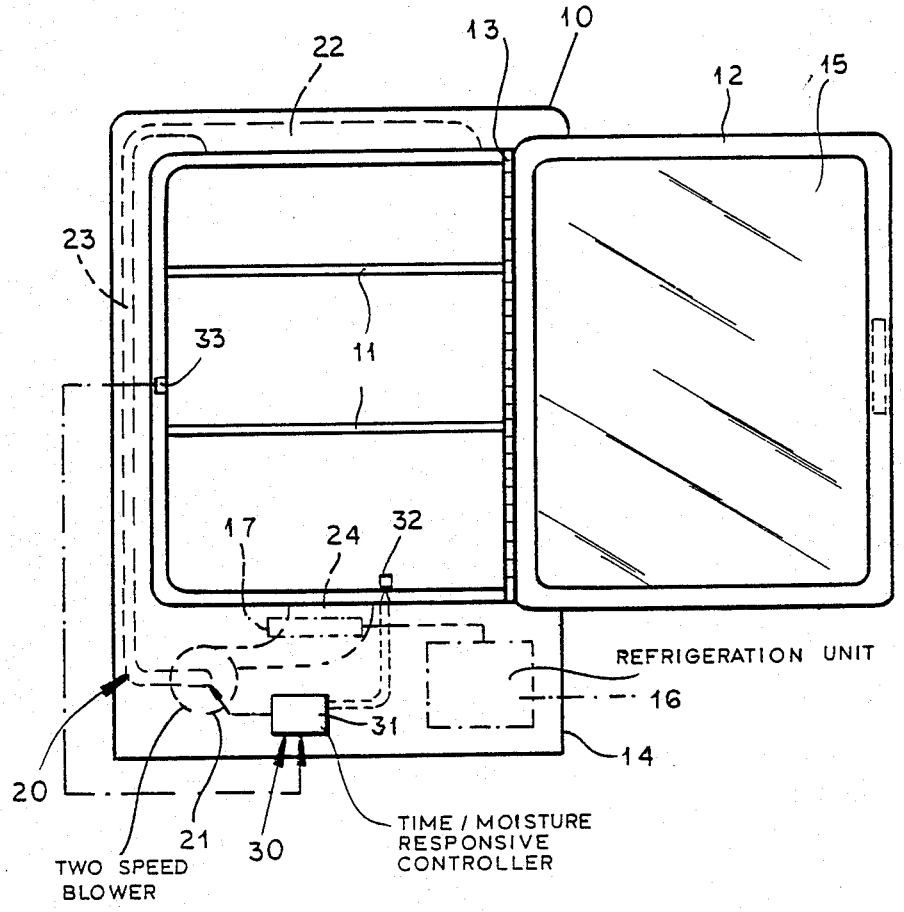
22
13
10
12
15
23
33
11
17
24
32
REFRIGERATION UNIT
16
31
14
20
21
30
TIME / MOISTURE
RESPONSIVE
CONTROLLER
TWO SPEED
BLOWER

METHOD OF REMOVING A MIST COATING FROM THE INTERIOR FACE OF A GLAZED PANEL OF A REFRIGERATING CABINET

The present invention relates to a method of removing a coating of mist from the interior face of a glazed panel, especially of high thermally insulating glass, of a refrigerating cabinet after opening and closing of a door thereof. The invention also relates to a refrigerating cabinet for carrying out the method.

Refrigerating cabinets, for example refrigerating chests of the kind installed in shops, commonly possess at least one window through which the goods stored in the cabinet can be viewed. The window is frequently set in the door of the cabinet. Due to the low temperature in the cabinet, which can be between 10° C. and −30° C., good thermal insulation of the glazing is necessary so that the requisite cooling output can be kept low. High thermally insulating glazing usually consists of multi-pane insulating glass in which the intermediate spaces between the individual panes can be filled with specific gases and the panes appropriately coated. By this means it is possible to achieve a thermal conductivity coefficient k of less than 2 $W/m^2K$. By thermal conductivity coefficient k is understood the heat flux density referred to the temperature difference of the areas bounding the two sides of the glazing. Accordingly, for the thermal conductivity coefficient three components are to be taken into consideration: the component of the glazing itself, the component of the air layer bounding the warm side of the glazing and the component bounding the cold side of the glazing, corresponding to the equation $$k = \frac{1}{1/\alpha_i + 1/\alpha_a + R}$$

wherein R=the thermal transmission resistance of the glazing, and $\alpha_a$, $\alpha_i$=the thermal transfer coefficients outwardly and inwardly, respectively.

In the specification of k-values, the values for the thermal transfer coefficients are standardised on $\alpha_a=23$ $W/m^2K$ and $\alpha_i=8$ $W/m^2K$ corresponding to the mean conditions for vertical glazing in the building and construction industry.

In the following description, all specifications of k-values refer to these standardised boundary conditions. It is self-evident that in practice the actual values in the case of refrigerating cabinets may slightly deviate therefrom. Thus, the thermal transfer coefficient $\alpha_a$ between the glazing and the ambient space depends on inter alia the installation conditions and the prevailing air currents in the installation space. The same applies to the thermal transfer coefficient $\alpha_i$ for the interior of the cabinet. Also, it is to some extent dependent on the dimensions of the refrigerating cabinet and on the degree of forced air circulation.

The better the thermal insulation of the glazing, the smaller the risk that the glazing mists at the exterior side and adversely affects the view of the goods presented in the cabinet. This is based on the fact that with use of high thermally insulating glass with a low k-value the thermal conduction from the exterior side to the interior side of the glazing is small, and the temperature at the exterior side of the glazing differs only slightly from the ambient temperature. With use of glazings with moderate k-value, it has been proposed in German (Federal Republic) patent specification No. 21 58 147 to conduct an air current at the ambient temperature over the exterior side of the glazing. In practice the exterior side of the glazing is heated. Glazing with a moderate k-value has in practice, for example, a three-pane construction with two intermediate air spaces each of 6 millimeters width, wherein an electrically heatable coating for the prevention of misting is arranged on the side, remote from the intermediate air space, of the exterior pane. With such a construction, a k-value of about 2.4 $W/m^2K$ is obtained.

If, however, the door of a refrigerating cabinet is opened for removal of an article, it also forms on the interior side of the glazing a mist which after the closing of the door adversely affects visibility through the glazing. This mist at the interior side decomposes in the course of time. This occurs within about one minute in the case of the typical glazing with a k-value above 2 $W/m^2K$ and when the door was open for 10 seconds, if the relative air humidity is about 65%. In the case of high insulating glazing this mist duration substantially increases, approximately by a factor of 2.5 if the glazing has a k-value of 1 $W/m^2K$.

It is assumed that the essential reason for the prolongation of the mist duration are the different temperature differentials between interior pane and the interior space of the refrigerating cabinet in the case of glazing with a moderate k-value as opposed to high insulating glazing. The higher thermal transmission resistance of the latter has the result that this temperature differential is smaller. Thus the difference in the corresponding water vapour pressure as driving force for decomposition of the ice or water layer on the interior pane also reduces.

If the air circulation speed should be increased in the case of such a refrigerating cabinet and thus enlarge the inward thermal transfer coefficient $\alpha_i$ by way of the convective component, so would the temperature differential between interior pane and interior space be further reduced. Such a procedure thus does not give rise to any expectation of a reduction in the mist duration. Experiments have confirmed this. Moreover, from the viewpoint of smallest possible energy comsumption by the refrigerating cabinet, the pursuit of this path is not desirable, because the worsening of the k-value caused by the higher $\alpha_i$-value and the higher operation speed of the ventilator for the air circulation increase energy consumption. For this reason the air circulation speed is kept down to that directly needed for the necessary cooling of the interior space and temperature equalisation thereof. With use of high thermally insulating glazing this necessary speed of circulation of the air can be selected to be somewhat lower than in the case of glazing with a refrigerating moderate k-value, because the energy consumption as a whole is lower.

There are also various proposals for the defrosting or de-icing of refrigerating elements of refrigerating equipment, for example conduction of warm gases or liquids through the refrigerating elements, blowing the iced refrigerating elements with warm air, and other such methods (German (Fed. Rep.) patent specifications Nos. 27 45 962 and 29 19 257). These proposals cannot, however, contribute to the overcoming of the above-mentioned problem of making it possible for customers in a shop to view goods in a refrigerating cabinet without extended interruptions.

It is accordingly the principal object of the invention to remove the mist, formed at the interior face of glazing on opening of a door of a refrigerating cabinet, without high component costs and in an economic manner. Other objects and advantages of the invention will be apparent from the following description.

According to one aspect of the invention there is provided a method of removing a coating of mist from the interior face of a glazing panel of a refrigerating cabinet provided with air circulating means for forced circulation of air in the interior of the cabinet and with a door openable and closable for access for the interior of the cabinet, the method comprising the steps of causing the speed of the forced air circulation by the air circulating means in the interior of the cabinet after closing of the door to be increased to a value above a predetermined value for normal cooling operation of the cabinet, maintaining the speed of the forced air circulation at said increased value for a period sufficient to cause decomposition of the coating, and thereafter reducing the speed of the forced air circulation to said predetermined value for normal cooling operation.

According to another aspect of the invention there is provided a refrigerating cabinet for carrying out of the above method, the refrigerating cabinet being provided with a glazing panel forming a boundary between the interior and the exterior of the cabinet, multi-speed air circulating means for forced circulation of air in the interior of the cabinet, a door openable and closable for access to the interior of the cabinet, and control means arranged to be actuated by the door and to control the operation of the air circulating means to cause the speed of the forced air circulation in the interior of the cabinet after closing of the door to be increased to a value above a predetermined value for normal cooling operation of the cabinet and to be held at said increased value for a period sufficient to cause decomposition of a coating on the interior face of the panel and thereafter to cause the speed of forced air circulation to be reduced to said predetermined value for normal cooling operation.

An example of the method and an embodiment of the refrigerating cabinet will now be more particularly described. In a preferred example of this method, the speed of circulation of the air after closing of the door is temporarily increased until the coating has decomposed and thereafter the speed is reduced back to the value required for normal cooling operation. For preference, the speed of circulation is increased to 1.5 to 4 times, preferably to 2.5 times, the value required for the normal cooling operation. It has proved that such a—only temporary—increase of the speed of air circulation after the closing of the door leads to a quick removal of the mist at the interior face. The time which elapses between closing of the door and complete removal of the mist is at least half that applicable without the described measures and is thus in the vicinity of the time taken for decomposition of the mist at the interior face of glazing with a moderate k-value. The method is, nonetheless, advantageously usable in the case of glazing with a moderate k-value and may bring about a reduction of the previously accepted mist duration by about 30%.

In a preferred embodiment of a refrigerating cabinet for carrying out the method, the cabinet has at least one door and glazing, especially high thermally insulating glazing, in the region of the door and/or the walls, and is fitted with a blower for forced air circulation. The blower is a 2-stage blower and associated therewith is control means with a switch actuable on closing of the door. During normal cooling operation the blower runs at the lower rotational speed. After closing of the door following a period when it has been open, the second stage of the blower is switched on, so that the blower runs at the higher rotational speed and correspondingly thereto the speed of circulation of the air in the refrigerating cabinet is increased. After removal of the mist at the interior face of the glazing the blower is switched back to the stage corresponding to normal cooling operation.

The point in time at which the switching back of the blower takes place can, in the simplest case, be predetermined through construction of the switch as a time relay, the timing of which can be set according to the respective operating conditions.

Another possibility for switching of the blower back to normal cooling operation after removal of the mist can be provision of a moisture measuring device which is arranged at the interior face of the glazing and is connected to serve as an actual value transmitter in a relay circuit controlling the switch. After the switch has been actuated by the closing of the door and the second stage of the blower has been switched on, the relay circuit holds the switch in its switched setting until the moisture measuring device ceases to deliver a moisture indication. The switch then returns to the setting for normal cooling operation.

The method exemplifying the invention can thus be put into effect without significant cost or complication. It is merely necessary to equip the refrigerating cabinet concerned with a 2-stage blower and an associated switching device which, in the simplest case, merely consists of a time relay. Especially goods results can be obtained if the glazing of the refrigerating cabinet consists of multi-pane insulating glass, with the interior pane at the side of the cooling chamber being provided with an infrared reflection layer (see the specification of German (Fed. Rep.) Patent Application No. P 37 00 076.4).

BRIEF DESCRIPTION OF THE DRAWING

The above and other objects features and advantages of the present invention will become more readily apparent from the following description, reference being made to the accompanying drawing in which:

The sole FIGURE of which is a diagrammatic elevational view of a refrigerating cabinet embodying the principles of the present invention.

SPECIFIC DESCRIPTION

In the drawing, we have shown a refrigerating cabinet 10 which comprises shelves 11 and a door 12 hinged at 13 to the housing 14 of the cabinet, the door having a glazing panel 15 which creates a boundary between the interior and exterior of the cabinet.

The cabinet is provided with a refrigeration unit 16 in the usual manner and shown only diagrammatically because it is not material to the subject of this invention. In addition, however, the cabinet contains a multi-speed air circulation means represented at 20 for the forced circulation of air in the interior of the cabinet. In addition, a control means generally represented at 30 is arranged to be actuated by the door and to control the operation of the air circulating means to cause the speed of the forced air circulation in the interior of the cabinet, after closing of the door, to be increased to a value above a predetermined value for normal cooling operation of the cabinet and to hold this increased value of forced air circulation for a period sufficient to eliminate a coating of mist which may form on the interior face of the panel 15 which is visible in the drawing because the door is open. The control means 30 thereafter causes the speed of forced air circulation to be reduced to the predetermined value for normal cooling operation.

In particular, the air circulating means 20 can comprise a two-speed blower 21 having an air intake 22 and a duct 23 connecting that intake with the suction side of the blower whose output side is connected to a discharge port 24 returning the circulatad air to the refrigerator through a register 17 of the refrigeration unit.

The control means can comprise a time relay switch 31 which can be connected with a moisture sensor 32 adapted to overide the time relay and with a switch 33 activated by the opening of the door. The panel 15 of the door should be composed of glass having high thermal insulating properties as described.

In operation, the door 12 may be opened to allow access to the interior of the cabinet. This causes moisture to bead up on the inner surface of the panel 15. When the door is then closed, switch 33 is activated to trigger the time relay 31 and switch the motor 21 into its high speed mode from its normal circulating mode. This enhanced circulation is maintained for a period of time set by the relay unless the moisture sensor 32 detects excess moisture in the environment of the door at the interior face of the glazing panel 15. In that case, the shut off period is extended and the blower will continue to operate with enhanced flow. When the moisture level then drops to a normal value the relay 31 will return the blower to its normal circulation speed.

We claim:

1. A method of removing a coating of mist from the interior face of a glazing panel of a refrigerating cabinet provided with air circulating means for forced circulation of air in the interior of the cabinet and with a door openable and closable for access to the interior of the cabinet, the method comprising the steps of causing the speed of the forced air circulation by said air circulating means in the interior of the cabinet after closing of said door to be increased to a value above a predetermined value for normal cooling operation of the cabinet, maintaining the speed of the forced air circulation at said increased value for a period sufficient to cause decomposition of said coating, and thereafter reducing the speed of the forced air circulation to said predetermined value for normal cooling operation.

2. A method according to claim 1, wherein said increased value is 1.5 to 4.0 times said predetermined value for normal cooling operation.

3. A method according to claim 2, wherein said increased value is substantially 2.5 times said predetermined value for normal cooling operation.

4. A refrigerating cabinet for carrying out the method according to claim 1, the refrigerating cabinet being provided with a glazing panel forming a boundary between the interior and the exterior of the cabinet, multi-speed air circulating means for forced circulation of air in the interior of the cabinet, a door openable and closable for access to the interior of the cabinet, and control means arranged to be actuated by said door and to control the operation of said air circulating means to cause the speed of the forced air circulation in the interior of the cabinet after closing of said door to be increased to a value above a predetermined value for normal cooling operation of the cabinet and to be held at said increased value for a period sufficient to cause decomposition of a coating of mist on the interior face of said panel and thereafter to cause the speed of forced air circulation to be reduced to said predetermined value for normal cooling operation.

5. A refrigerating cabinet according to claim 4, the air circulating means comprising a two-stage air blower.

6. A refrigerating cabinet according to claim 4, wherein said glazed panel comprises glass with a high thermal insulating property.

7. A refrigerating cabinet according to claim 4, the control means comprising time relay switching means.

8. A refrigerating cabinet according to claim 4, the control means comprising switching means, regulating means to regulate operation of the switching means, and moisture measuring means arranged to provide a measurement of moisture at the interior face of said glazing panel and to control said regulating means in dependence on the provided moisture measurement.

* * * * *